US005496131A

United States Patent [19]

Tibäck

[11] Patent Number: 5,496,131

[45] Date of Patent: Mar. 5, 1996

[54] TOOL FOR ROAD PLANING CUTTER

[75] Inventor: Bo G. Tibäck, Borlänge, Sweden

[73] Assignee: Sandvik AB, Sandviken, Sweden

[21] Appl. No.: 281,276

[22] Filed: Jul. 27, 1994

[30] Foreign Application Priority Data

Jan. 27, 1992 [SE] Sweden ..... 9200219

[51] Int. Cl.[6] ..... E01C 23/12

[52] U.S. Cl. ..... 299/40.1; 37/446; 172/772.5

[58] Field of Search ..... 404/75, 90, 91; 299/24, 40, 86; 37/446, 452; 172/772, 772.5

[56] References Cited

U.S. PATENT DOCUMENTS

| | | | |
|---|---|---|---|
| 4,783,123 | 11/1988 | Ottestad . | |
| 4,784,517 | 11/1988 | Bergqvist et al. . | |
| 5,054,217 | 10/1991 | Nilsson et al. . | |
| 5,213,171 | 5/1993 | Clench et al. | 175/420.1 |

OTHER PUBLICATIONS

"Test och utvärdering av slitage–motståndet hos Vägstål" (Teknikum, Uppsala universitet, Dec. 1983. ISSN 0346–8887).

"Tribological testing of traditional road–grading steel leading to the evolution of new road preparation concepts", (Wear 130, 1989, s. 151–165).

"Model studies on cutting, grinding and abrasive wear of materials" (Teknikum, Uppsala universitet, ISBN 91–554–222–5).

*Primary Examiner*—William P. Neuder
*Attorney, Agent, or Firm*—Burns, Doane, Swecker & Mathis

[57] ABSTRACT

The present invention relates to a tool and a metal tip of the tool. The tool includes a tool blank, a bearing portion and a metal tip where the tool is intended to be rotatably mounted in a road planing cutter. The longitudinal axis of the tool forms, in active position, an angle V in the interval 20°–90° relative to the road surface. The metal tip includes a portion for attachment to the tool blank and a cylindrical or slightly conical portion that is connected to a shape-defining surface located at the opposite end of the metal tip in relation to the attachment portion. The metal tip is mounted in the tool and contacts the road surface in the active position. The metal tip has a sharp edge in the transition between the cylindrical or slightly conical portion and the shape-defining surface.

20 Claims, 3 Drawing Sheets

TOOL FOR ROAD PLANING CUTTER

BACKGROUND AND SUMMARY OF THE PRESENT INVENTION

The present invention relates to a tool intended to be rotatably mounted in a road planing cutter. The tool in its operative position carries out snow clearing and scraping of especially tough/hard ice and of other tough/hard road surface. The longitudinal axis of the tool forms an angle with the road surface in the interval of 20°–90° and a metal tip or a hard metal tip of the tool contacts the road surface in the operative position of the tool. The invention also relates to the metal tip per se and a method to work road surfaces.

The conventional road-grading steels have during the years been improved step by step due to the general technical development. The simpler physical properties like hardness and toughness, and how they are affected by the chemical composition and heat treatment of the steels, have been fairly well known. Already decades ago the conventional steels have empirically reached their optimum length of life. This is clearly shown in the publication "Test och utvärdering av slitage-motståndet hos Vägstål" (Teknikum, Uppsala universitet, December 1983. ISSN 0346-8887).

The knowledge of tribology, i.e., the teaching of friction, lubrication and wearing, was however rather rudimentary outside the academic world. The manufacturers of the conventional road planing cutters had virtually no knowledge of tribology. Studies of the research results of recent years have however shown that the wearing mechanics when working road surfaces are no isolated functions but cooperate with each other under the influence of a number of other parameters. These studies have shown that the wearing of tool and pin is in micro scale. Fractures in and outside grain boundaries and wearing of tools takes place on surfaces that can be smaller than a square millimeter. This is documented in the publication "Tribological testing of traditional road-grading steel leading to the evolution of new road preparation concepts", (Wear 130, 1989, s. 151–165).

Systematic and methodical follow-up has occurred from 1984 and onwards and the use of the SYSTEM 2000® road-working equipment of Sandvik AB, a system solution for road planers in maintenance work that relies on SE-A-8404673-9, which corresponds to U.S. Pat. No. 4,784,517 which is hereby incorporated by reference in its entirety. However, these follow ups have now shown that cemented carbide tools in the market cannot solve all the frequent problems that arise in working road surfaces. This is partly due to the fact that the pins as a result of the working leave a roadway with grooves that may be troublesome and that too much material passes between the pins. Attempts to eliminate these inconveniences have previously been tried by placing the pins closer to each other by drilling the mounting holes in the mounting plate closer to each other. This change gave rise to mounting problems and problems with too low surface pressure to work the material underneath.

From SE-A-8404673-9 (the so-called conventional pins) is previously known a road planing cutter as mentioned above. The tools used in connection with the road planing cutter have been of standard design, i.e., the same type of tools that are used for asphalt milling, coal breaking etc. These tools are thus designed to carry out a cutting operation and therefore a common feature of them is that the cemented carbide insert has a relatively pointed design to minimize the cutting forces. In early use of these conventional pins, standard pins, it was found that relatively extensive damage of the road surfacing occurred already at a few degrees increase of the angle between the longitudinal axis of the pin and the horizontal plane. It was also found that the relatively small increase of the angle also caused a rolling working to transfer into a cutting non-rolling working. This type of cutting is negative due to the fact that the material in, e.g., a gravel roadway was cut down and thereby the stone material, which gives the roadway its bearing capacity, was cut down and segregated into smaller fractions with lower bearing capacity. Also the wear upon the tool itself was more than ten times greater than when the angle was absolutely correct. The relatively minor increase in the angle also causes a relatively low specific contact pressure between tool and the road surface to rapidly transfer into an extremely high surface pressure with extensive damage to the road surfacing as a consequence. The pointed standard pins (SE-A-8404673-9) have thus a very small scope of latitude before damages occur both in the road surfacing and in the tool itself.

A further development of SYSTEM 2000® through SE-B-8701222-5 (the so-called blunt pin), shows that a tool with a smoothly curved shape defining surface has a large scope of latitude whereby the angle that the longitudinal axis of the tool forms with the horizontal plane can be varied within relatively wide limits without affecting the function of the tool to any degree worth mentioning. The friction/pressure and degree of working of the tool are fairly equal within 20°–90° inclination between the longitudinal axis of the tool and the horizontal plane. Also the working continually takes place as a rolling crushing working whereby very long life for the tool is achieved. The smoothly curved shape defining surfaces of the tool also continually cause a significant reduction of the maximum specific surface pressure against the ground, whereby damages in the road surfacing can be avoided to a high extent.

In these studies one has been able to distinguish between the totally different ways of working and working results of the conventional pins way to work material and the dull pins way to work material. It has therefore been possible to systematically and 10 methodically determine the system structure and type of motion and type of wear of the pins in the marketplace. It has therefore been possible to consider advantages and drawbacks of the different types of pins and their stability and limitation as regards function.

A disadvantage and weakness of the above mentioned pin with the rounded shape defining surfaces, that cause the structural limitation of the maximum surface pressure, is that the pin due to its design is not able to penetrate hard/tough ice or hard/tough other material that cannot be worked by crushing.

The above described pins and other known cemented carbide pins have bodies with a concave or conical portion that closest to their mounting part has an essentially larger diameter than the rest of the tool body. This design with a thicker base diameter and an essentially thinner tip diameter has been functionally determined by the original areas of use for the conventional cemented carbide tools, i.e., milling, cutting, working. This geometrical shape of the holder body for the cemented carbide tip does not bring about an optimum function of the tool nor does it solve all the technical problems inherent in ground preparation.

The previously known pins that were designed with a concave portion could also contribute to a premature breakdown through fracture of the conical portion due to the smaller diameter of the initially weaker thinner portion.

Two essentially different ways to work material from solid bodies have been described above. The first way is a solid body performing a sliding, cutting abrasive wearing. The other way is a rolling body performing a crushing working.

OBJECTS OF THE PRESENT INVENTION

An object of the invention is to provide a tool including a metal tip or cemented carbide tip with a special design, the tool being especially adapted for use on hard/tough ice and other hard/tough road surfacing. An aim is also to solve the problems mentioned above related to existing pins by changing the geometrical design. The larger diameter of the new pin also improves the rotation of the pin and thereby its length of life. By designing the pin with a substantially constant cylindrical diameter on the portion that holds the metal tip itself several technical problems are solved. With the tip design of the present invention, the tool can now manage to perform working that previously was not possible with conventional pins. This ability is due to the fact that working now takes place by rolling, cutting working with an optimum length of life.

The large diameter of the new pin prevents undue amounts of material to pass between the pins. The absence of a concave waist on the tools means considerably more material in the tool body whereby a longer length of life and strength is achieved.

The tools that are to be used both in hard/tough ice and hard/tough other material in the roadway must cover a larger working register than the tools described above.

The present invention has, as another object, to present a tool that essentially performs rolling, cutting working due to the metal tip being so designed that the angle between the longitudinal axis of the tool and the horizontal plane can be varied within wide limits to have the surface pressure successively increasing from minimum surface pressure at 90° to maximum surface pressure at about 40°. Due to the fact that the contact point of the metal tip is at a large distance from the center of rotation, such rotation is favored giving optimum length of life to the pin.

A further object of the present invention is to achieve a tool including a cemented carbide tip for a wider working field than has previously been possible with conventional tools.

According to the present invention the material is worked by cutting, rolling working, i.e., the present invention combines the planing cutting effect of the standard pins with rolling working of the above-mentioned pin with rounded shape defining surfaces.

Thus, the present invention brings about a third way to work material from solid bodies, i.e., a rolling body performs a cutting working. The third way is essentially different from the two ways mentioned above. Under certain conditions the ways of working are not present as isolated functions but are interworking under the influence of a great number of parameters. However, there is usually always a totally dominating working type, i.e., sliding, cutting; rolling, crushing or rolling, cutting.

SUMMARY OF THE PRESENT INVENTION

The present invention is characterized in that the metal tip includes a cylindrical or slightly conical portion and an end portion with a sharp shape defining edge. The end portion is attached to the cylindrical or slightly conical portion.

In a further aspect of the present invention, the tool blank, to which the metal tip is brazed, is cylindrical, i.e., with a constant diameter from the mounting end towards the road planing cutter to the attachment end against the metal tip. Further the diameter of the cylindrical portion is in one embodiment considerably larger at the top of the tool than in previously used types of pins.

A sharp shape defining edge is an edge that is sufficiently keen or sharp to provide a cutting working in any given material when performing road planing work. Thus, the definition of "sharp edge" can vary with regard to the material that is subject to working. When the cutting working, by wearing of the metal insert, ceases and the working is turned into crushing working the cutting insert is worn out. A comparison can be made with a turning tool that is worn out when it no longer has the ability to cut the material.

Due to the sharp edges of the metal tip a brittle fracture can more easily be created in the material that is worked resulting in a better economy. (Created brittle fractures propagate locally without further energy supplied). Through the publication "Model studies on cutting, grinding and abrasive wear of materials" (Teknikum, Uppsala universitet, ISBN 91-554 -222-5) the great importance of the cutting angle for the working result has also been shown. The present invention uses, inter alia, the fact that the so-called BUE built-up edge prolongs the life of the metal pins due to the fact that material building up. This BUE decreases the wear upon the metal tip itself. A metal tip with a tube-shaped end surface and a metal pin with an internal cone increases the specific surface pressure within a wide range of the angle relative to the ground surface and also essentially increases the possibility of the tool to easily penetrate hard and/or tough material and thereby facilitate optimum working through rolling, cutting working.

These pins with sharp cylindrical or slightly conical, shape defining surfaces can theoretically be described as consisting of an endless number of small tips that together constitute the circumference of the end surface of the cylindrical or slightly conical envelope surface of the metal tip. In practice, it has also turned out that the working at every single point of time and location along the tool surface and the road section takes place on an extraordinarily restricted area. Therefore it has been possible to optimize the present invention pin for rotatably cutting tools.

BRIEF DESCRIPTION OF THE DRAWINGS

The invention will now be described more in detail by way of embodiments where references to the drawing figures are effected by using numeral references, and wherein:

FIG. 2 is a view of a first embodiment of the metal tip where

FIG. 3 is a view of a second embodiment of the metal tip where

FIG. 4 is a view of a third embodiment of the metal tip where FIG. 5 is a view of a fourth embodiment of the metal tip where

DETAILED DESCRIPTION OF THE PREFERRED EMBODIMENTS

Figure 1:
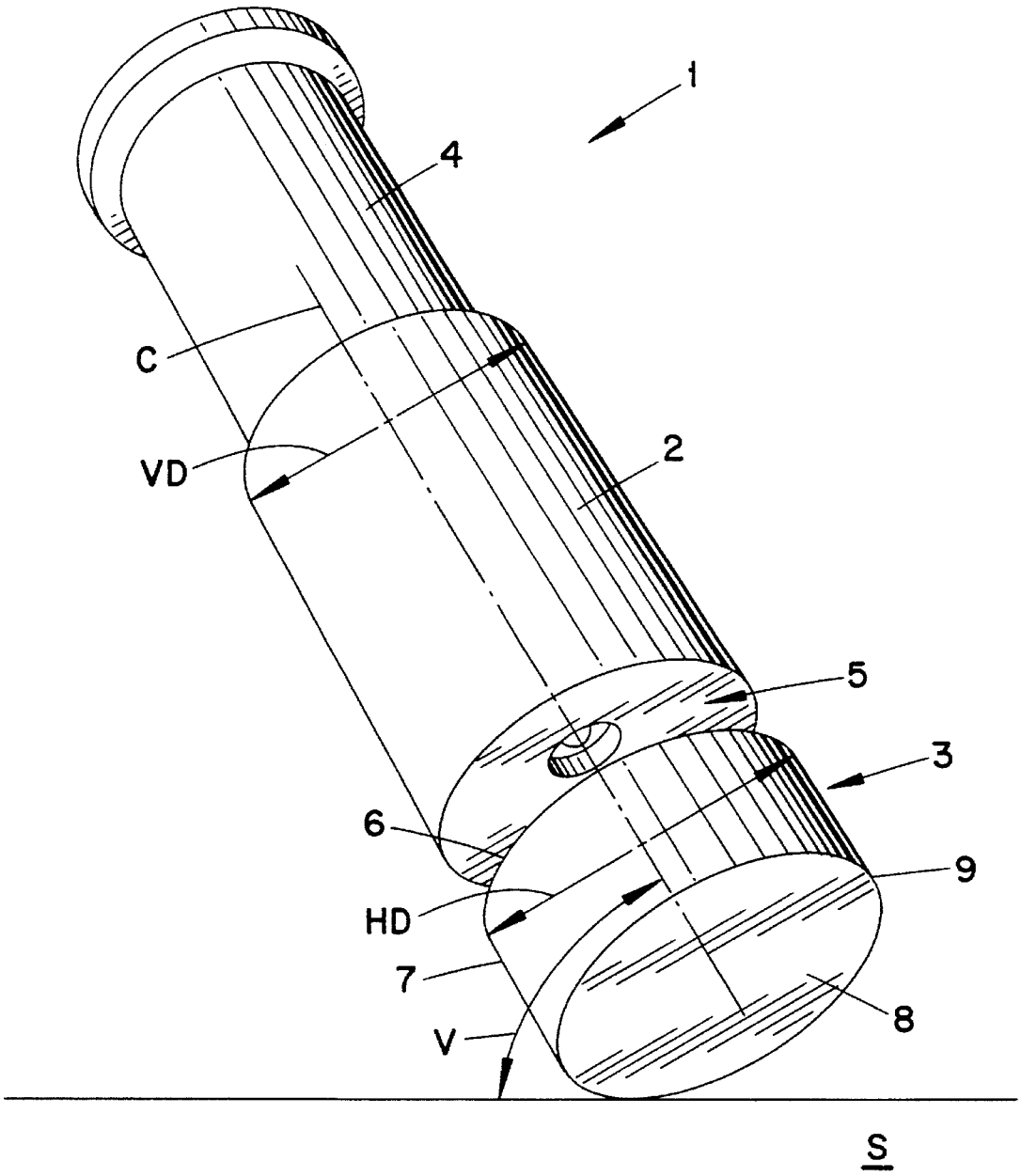
FIG. 1 is a view of a tool equipped with a metal tip according to the invention with the metal tip at some distance from the tool blank.

The tool 1 is intended to be mounted on a road planing cutter (not shown) of the type described and shown in U.S. Pat. No. 4,784,571 which is incorporated herein by reference. The tool 1 includes a tool blank 2 with a metal tip 3 connected to the lower portion of the tool blank 2 and a bearing portion 4 connected to the upper portion of the tool blank 2. The tool blank is cylindrically designed whereby a constant tool diameter VD is present from the upper end of the tool blank 2, i.e., the mounting end towards the road planing cutter, to the attachment end for the metal tip. The bearing portion 4, that includes a surrounding clip (not shown) for the mounting, is intended to be rotatably secured in the road planing cutter. The bearing portion 4 is of quite conventional type for these types of rotating tools. The lower portion of the tool blank is provided with a conventional attachment portion 5 for the metal tip 3. The joint between the tool blank 2 and the metal tip 3 is a brazing joint. FIG. 1, however, shows the tool 1 where the tool blank 2 and the metal tip 3 have been separated for the sake of clearness and terminology.

This cylindrical tool can be mounted on conventional road planing cutters with a standardized center distance between the tools, the so-called pins, whereby the diameter of the tools have been increased to have the distance A or, in other words, the distance between the envelope surfaces of adjacent ones of the tools to be 1–21 mm. Thus the diameter VD of the tools is increased if conventional road planing cutters are used. The center distance CA between the center axis of two adjacent tools in the road planing cutter is CA=VD/2+A+VD/2=VD+A.

In case the road planing cutters are to be newly manufactured, the center distance CA is adapted to a chosen optimum diameter VD of the tools where the tool diameter VD depends on the working conditions.

Towards the tool blank 2, the metal tip 3 is provided with a rear end surface or contact portion 6 serving as an attachment portion to be brazed against the front end surface or attachment portion 5 of the tool blank 2. The contact portion 6 is of conventional design. Further the metal tip 3 is provided with a cylindrical or slightly conical portion 7 and a shape defining surface or lower end surface 8. Between the cylindrical or slightly conical 7 and the end surface 8 a sharp edge 9 is provided, i.e., the circular "corner" of the metal tip consists of a sharp edge 9. The tip contacts the ground or road surface S at an angle V of 20°–90° relative to a longitudinal axis C at the tip.

The metal tip 3 that is brazed to the tool 1 has a diameter HD that corresponds to the tool diameter VD, at least at one location along the length of the metal tip. In case the metal tip is slightly conical its diameter HD naturally varies along its length. Depending on whether the conicity is the diameter of the metal tip at the transition with the surface 8.

Also, a double conical metal tip is possible whereby the conicity can increase or decrease towards the longitudinal center of the tip and then decrease or increase up to surface 8.

The metal tip shows in all consecutive embodiments a sharp edge between its envelope surface and its surface 8. This sharp edge is, as previously mentioned, defined by working mode and the ground.

Figure 2A:
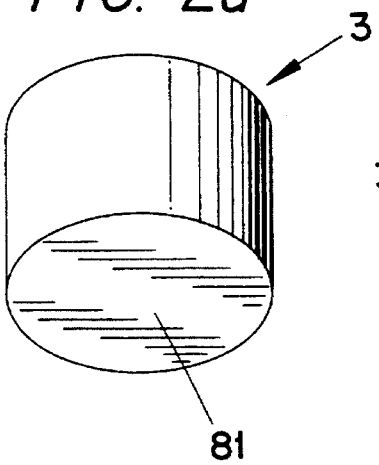
FIG. 2*a* is a perspective view from underneath and FIG. 2*b* is a cross-sectional view taken axially.
Figure 2B:
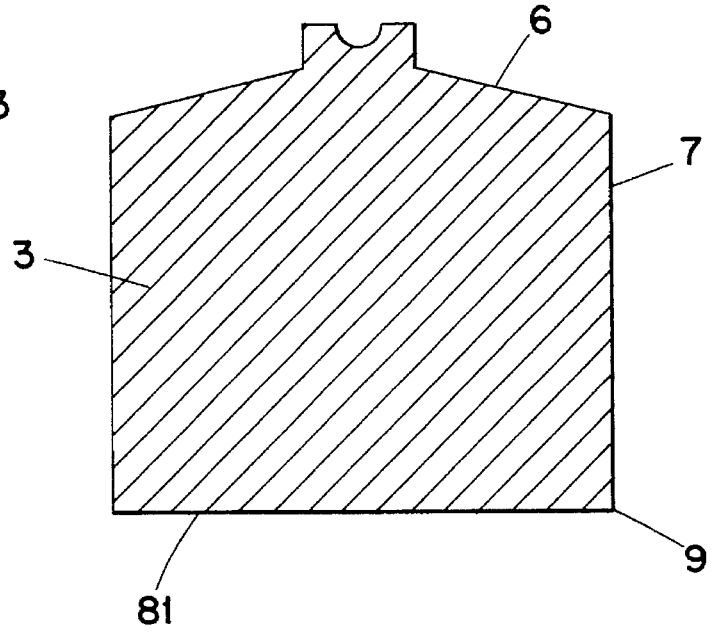

As shown in FIGS. 2*a*, 2*b*, the metal tip according to the present invention has a planar lower end surface 81. The angle between the surface 8 and the envelope surface 7 of the metal tip is about 90°. This angle can in this embodiment vary between 80° and 110°.

Figure 3A:
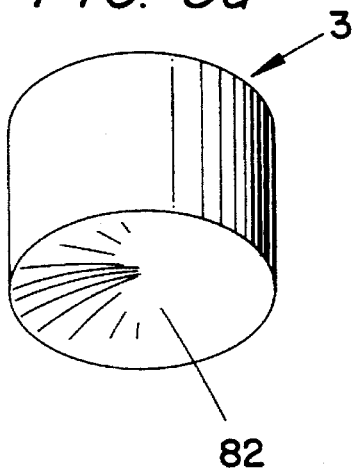
FIG. 3*a* is a perspective view from underneath and FIG. 3*b* is a cross-sectional view taken axially.
Figure 3B:
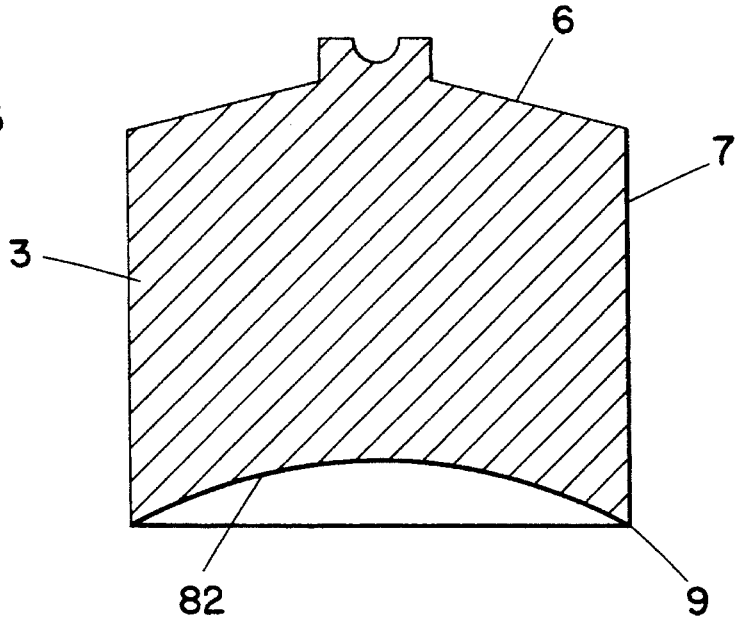
Figure 4A:
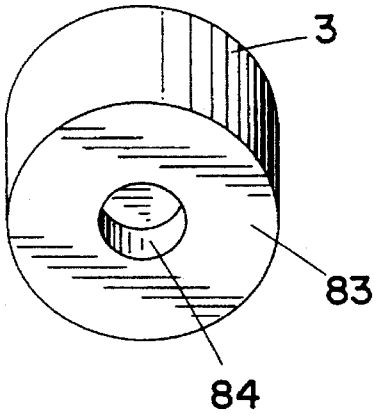
FIG. 4*a* is a perspective view from underneath and FIG. 4*b* is a cross-sectional view taken axially.
Figure 4B:
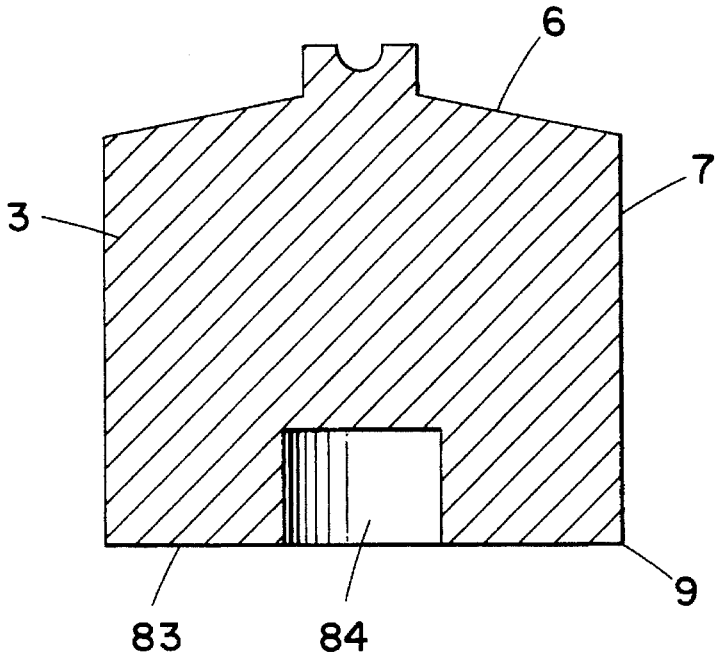

In a second embodiment, shown in FIGS. 3*a*, 3*b*, the lower end surface of the metal tip is in the shape of a concave, circular surface 82 that can have the shape of a spherical cap having a radius of curvature of 8–19 mm.

In a third embodiment according to FIGS. 7*a*, 7*b*, the lower end surface of the metal tip is shown as a planar circular end surface 83 with a central cylindrical recess 84 where the diameter of the recess is between D/2 and D/3 where D is the diameter of the metal tip at the transition to the surface 83.

Figure 5A:
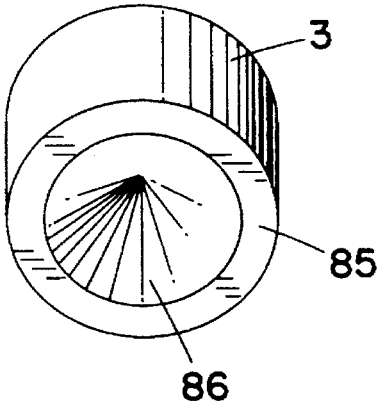
FIG. 5*a* is a perspective view from underneath and FIG. 5*b* is a cross-sectional view taken axially.
Figure 5B:
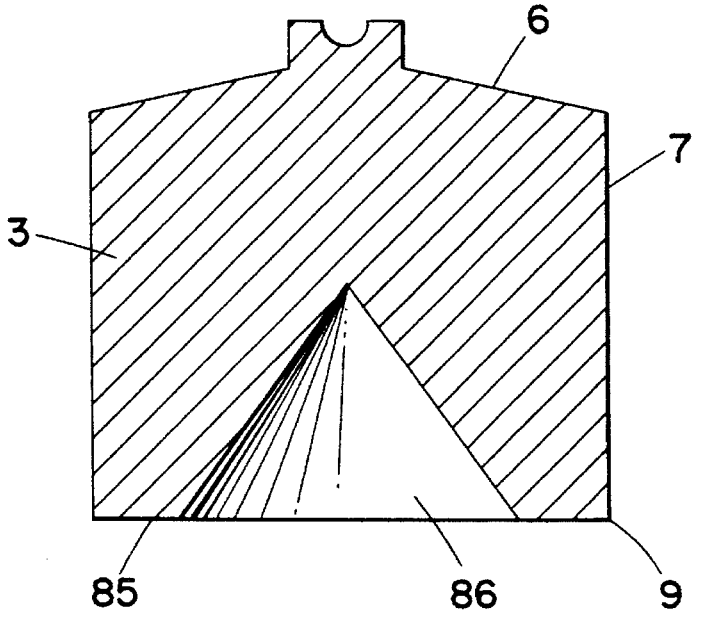

In a fourth embodiment according to FIGS. 5*a*, 5*b*, the lower end surface is designed as a planar, circular end surface 85 with a centrally located conical recess 86 with a largest diameter of between D/2 and D/3 where D is the diameter of metal tip at the transition to the surface 85, i.e., the diameter at the transition into the end surface 85. The depth of the recess, i.e., the height of the cone is 3–8 mm.

Thus, the metal tip 3 according to the invention has a planar end surface, circular end surface, concave end surface, annular end surface with cylindrical recess or annular end surface with internal cone in the center. In all embodiments, the metal tip 3 has a sharp edge 9 in the transition between the envelope surface of the cylindrical or slightly conical portion and the end surface 8 whereby the angle of action against the material that is to be worked is equal to or less than 110°, preferably about 45°–90° whereby also very tough/hard material can be worked maintaining a rolling working for optimum economy.

For most applications the metal tip 3 is of cemented carbide but can also cover certain requirements when manufactured in high speed steel or free cutting steel.

In accordance with the method of operating the tool according to the present invention on hard/tough ice and other hard/tough other material, a plurality of tools are rotatably mounted in a road planing cutter. The tools have metal tips 3 for contacting the road surface. The metal tips of the tools contact the road surface for working the road surface by a rolling, cutting working action with a sharp edge 9 of the metal tip.

The principles, preferred embodiments, and mode of operation have been described in the foregoing specification. However, the invention which is intended to be protected is not limited to the embodiments disclosed. Variations or changes may be made by others that fall within the spirit and scope of the claims appended hereto.

What is claimed is:

1. A road planing tool including a tool blank, a bearing portion disposed at a rear end of said tool blank and a metal tip disposed at a front end of said tool blank, said bearing portion configured to be freely rotatably mounted in a road planing apparatus with said metal tip contacting the road surface, a longitudinal axis of said tool forming, in an operative position of the road planing apparatus, an angle in the interval 20°–90° relative to a road surface, said metal tip including a rear end surface attached to said front end of said tool blank and having one of a cylindrical or slightly conical portion extending forwardly from said rear end surface to a front end surface of said metal tip, the metal tip having a sharp circular cutting edge in the transition between said front end surface and said one of the cylindrical or slightly conical portion.

2. Tool according claim 1, wherein the tool blank is cylindrical from the bearing portion facing towards the road planing apparatus to the attachment portion abutting the attachment portion of the metal tip.

3. Tool according to claim 1 wherein each tool mounted in the road planing apparatus has a spacing from its envelope surface to an envelope surface of an adjacent tool, said spacing being in the interval 1–21 mm.

4. Tool according to claim 3, wherein the spacing between two tools mounted adjacent each other is defined by the center distance between one mounting means in the road planing apparatus and the diameter of the tools.

5. Tool according to claim 1, wherein the metal tip has a diameter that corresponds to the diameter of the tool blank, at least at one location along the length of the metal tip.

6. Tool according to claim 1, wherein the metal tip is cemented carbide.

7. Tool according to claim 1, wherein the tip has a frusto-conical exterior that increases toward the end surface.

8. Tool according to claim 1, wherein the tip has a frusto-conical exterior that decreases toward the end surface.

9. Tool according to claim 1, wherein the tip has an exterior surface that is cylindrical along its entire length.

10. A road planing cutter tip intended to be connected to a tool blank for creating a rotatable tool for mounting in a road planing apparatus, said tip being formed of metal and including a rear attachment portion for attachment to the tool blank, said tip having one of a cylindrical and slightly conical portion extending between said rear attachment portion and said front end surface of said metal tip, the metal tip having a sharp circular cutting edge in the transition between said front end surface and said one of the cylindrical and slightly conical portion.

11. Metal tip according to claim 10, wherein the end surface has the shape of a planar circular surface.

12. Metal tip according to claim 10, wherein the end surface has the shape of a concave, circular surface.

13. Metal tip according to claim 12, wherein the concave end surface of the metal tip has the shape of a spherical cap with a radius of curvature of 8–19 mm.

14. Metal tip according to claim 10, wherein the end surface has the shape of a planar circular end surface with a centrally located, cylindrical recess.

15. Metal tip according to claim 14, wherein the cylindrical recess in the end surface has a diameter between D/2 and D/3, where D is the outer diameter of the planar circular end surface.

16. Metal tip according to claim 10, wherein the end surface has the shape of a planar, circular end surface with a centrally located, conical recess.

17. Metal tip according to claim 16, wherein the conical recess has a largest diameter of between D/2 and D/3, where D is the diameter of the metal tip at the outer diameter of the planar circular end surface.

18. Metal tip according to claim 16, wherein the conical recess has a depth of 3–8 mm.

19. Metal tip according to claim 10, wherein the metal tip is of cemented carbide.

20. Method for working road surfaces, using a plurality of tools, comprising the steps of rotatably mounting the plurality of tools on a road planing vehicle, each of said tools having a metal tip with a sharp circular cutting edge at a free end thereof, contacting the road surface with the metal tips of the tools, and advancing the vehicle such that the metal tips work the road surface by a rolling, cutting working action of the sharp cutting edges of the metal tips.

* * * * *